United States Patent [19]

Meinerding et al.

[11] Patent Number: 4,807,782

[45] Date of Patent: Feb. 28, 1989

[54] CONTENTS-SAVER PLASTIC DISPENSING TUBE

[76] Inventors: Wesley C. Meinerding, 1019 Knollwood Rd., NW., Canton, Ohio 44708; Donavon L. Favre, 1600 S. Joyce St., Apt. C503, Arlington, Va. 22202

[21] Appl. No.: 21,747

[22] Filed: Mar. 4, 1987

[51] Int. Cl.[4] ..... B65D 35/08

[52] U.S. Cl. ..... 222/1; 222/107

[58] Field of Search ..... 222/95, 98, 99, 100, 222/107, 103, 92, 1; 24/17 B, 482, 546; 40/21 R, 310; 383/89, 90; 132/42 R, 44; 206/805

[56] References Cited

U.S. PATENT DOCUMENTS

| | | | |
|---|---|---|---|
| 224,958 | 2/1880 | Rowland . | |
| 424,411 | 3/1890 | Fielder | 383/90 |
| 1,028,489 | 6/1912 | Priddat . | |
| 1,714,741 | 5/1929 | Urquhart | 222/107 |
| 2,669,047 | 2/1954 | Rieger . | |
| 2,862,647 | 12/1958 | Dietz | 222/99 |
| 2,976,629 | 3/1961 | Brixius et al. | 40/310 |
| 3,453,758 | 7/1969 | Soref et al. | 40/21 R |

FOREIGN PATENT DOCUMENTS

| | | | |
|---|---|---|---|
| 321875 | 11/1929 | Czechoslovakia | 222/103 |
| 1439342 | 6/1976 | United Kingdom . | |

*Primary Examiner*—Michael S. Huppert
*Attorney, Agent, or Firm*—Donavon Lee Favre

[57] ABSTRACT

A flexible wall dispensing tube, such as a toothpaste tube, has a resilient means such as a rubber band attached to the bottom of the tube to prevent the bottom of the tube from unwinding after it has been wound up.

7 Claims, 1 Drawing Sheet

CONTENTS-SAVER PLASTIC DISPENSING TUBE

BRIEF SUMMARY OF THE INVENTION

The present invention is directed to a contents saving plastic dispensing tube such as a tooth paste tube.

To be more specific, the invention is directed to an improvement in a conventional flexible wall dispensing tube having a discharge nozzle at one end and a permanant closure at the other end, such as a toothpaste tube. The improvement is a resilient holding means which prevents unwinding of the other end after it is wound up after use.

The improvement is particularly applicable to plastic tubes as plastic tubes have a greater tendency to unwind after they are rolled up than metal tubes. It is preferred that the resilient holding means be one piece, as a one piece holding means is usually easier to make and less expensive than a multipiece holding means. In one form the resilient holding means is a resilient strip having a length greater than the width of the tube, and is attached parallel to the end of the tube having the permanent closure. The strip can be rolled up in the center of a roll when the tube is wound up, and the protruding ends can be folded over the unrolled tube to keep the rolled section from unwinding. The metal strip can be made of iron, bendable steel, copper, or any metal or plastic which can be bent over the tube, and which will, after being pressed into a position, retain that position. Plastic covered metal is also usable and has a more attractive appearance.

An elastic band is the most preferable means for holding the rolled up portion of the plastic tube in place. The elastic band can also be covered at least in part with plastic, such as a sleeve, to improve its appearance.

Another form which the resilient holding means can take is a U shaped clamp which fits over the end of the tube having the flat permanent closure. Again the most preferred means for preventing the rolled up end of the tube from unrolling is a rubber band attached to the rolled up end to prevent unwinding of the tube. The rubber band is attached to the bottom of the tube, and as each roll is made, the rubber band is moved to the outer surface of the tube opposing the roll. The rubber band is preferably attached parallel to the bottom end of the tube, the bottom end being the non-dispensing end. The dispensing end is considered the top end.

When appearances are important it is preferred that a sleeve surround a portion of the lengthwise direction of the rubber band. The lengthwise direction surrounded is preferrably the portion which goes over the lower unrolled length of the tube and the remainder of the rubber band is attached to the center of the roll and pulls the roll to the remainder of the tube. The sleeve can be decorated or can contain advertising such as a brand name. Again primarily for asthetic purposes the sleeve preferrably has a length equal to the width of the bottom end of the tube. To maintain the clarity of the printing on the sleeve, the sleeve is preferrably inextensible. Thus one or more letters or numbers printed on the sleeve will remain clearly readable.

DETAILED DESCRIPTION

Figure 1:
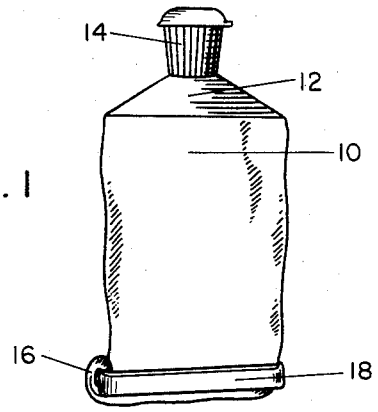
FIG. 1 shows a partially collapsed dispensing tube having the rolled up portion held in place by a rubber band.

FIG. 1 illustrates a flexible walled dispensing tube made of plastic comprising a tubular body 10 having at the discharge end a shoulder 12 from which projects a threaded hollow nozzle bearing a removable closure cap 14. The lower portion of the tube 16 is rolled up, and is held in place by rubber band 18 which passes through the center of the roll and across the opposing face of tube 10.

Figure 2A:
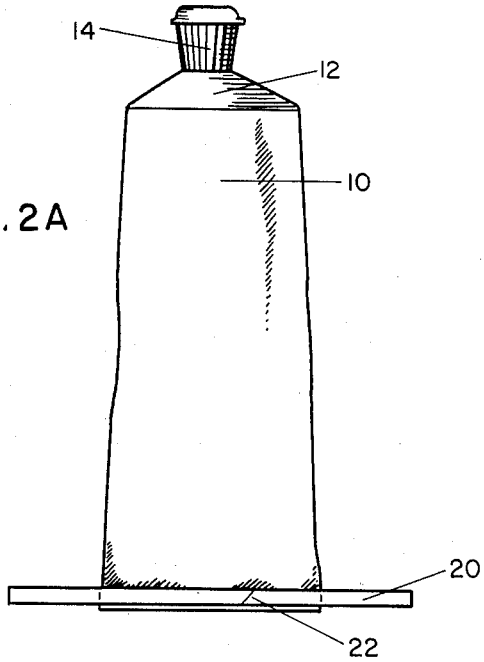
FIG. 2A shows a resilient strip attached to the bottom end of a dispensing tube.
Figure 2B:
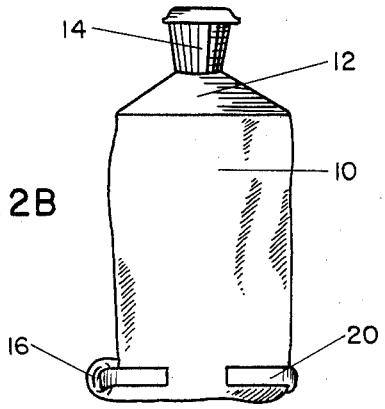
FIG. 2B shows the ends of resilient strip of 2A folded around the tube to prevent unrolling.

The tube of FIG. 2A varies from that of FIG. 1 in that a metal clasp 20 is employed to hold the rolled up section of the tube in place instead of rubber band 18. Clasp 20 is held in place by dead fold 22 at the bottom of tube 10. FIG. 2B shows clasp 20 extending through the center of rolled up portion 16 and the ends of clasp 20 folded over the opposing face of tube 10 to hold rolled up section 16 from unrolling.

Figure 3:
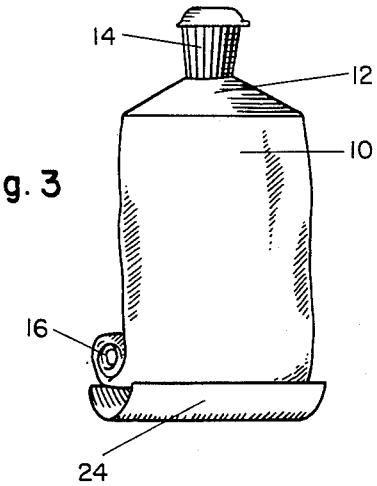
FIG. 3 shows a U shaped spring clip designed to prevent the rolled up bottom end of a dispensing tube from unrolling.

Referring now to FIG. 3, a U shaped spring clip 24 is shown in position to be applied to rolled up section 16 to prevent the rolled up section 16 from unrolling.

Figure 4:
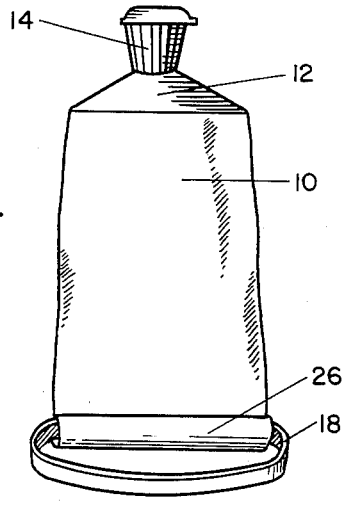
FIG. 4 shows the rubber band attached to the bottom of the tube by a dead fold.

FIG. 4 shows the rubber band 18 attached to the bottom of the tube 10 by a dead fold 26.

Figure 5:
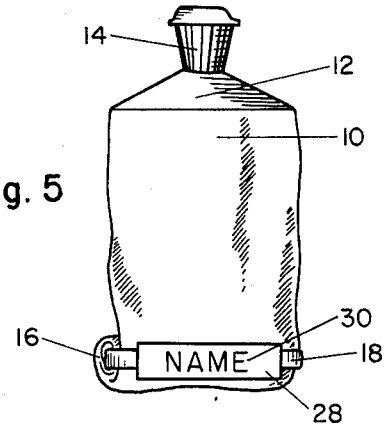
FIG. 5 shows a sleeve with writting surrounding a portion of the lengthwise direction of the rubber band. The sleeve has a width slightly wider than the rubber band.

FIG. 5 shows a sleeve 28 with writing 30 surrounding a portion of the lengthwise direction of the rubber band 18. The sleeve 28 has a width slightly wider than the width of the rubber band 18.

We claim:

1. A flexible wall dispensing tube, made of plastic, the tube having a discharge nozzle at one end and a permanent closure at the other end, wherein the improvement comprises a rubber band attached to the other end of the tube by a folded over portion of the other end, which folded over portion covers a portion of the rubber band and leaves a portion of the rubber band uncovered by the folded over portion, and the rubber band positioned parallel to the other end to hold the lower tube portion in place and to prevent unwinding of the other end after it is wound, the exposed portion of the rubber band being moved to an outer surface of the tube opposing a roll as each roll is made.

2. A plastic, flexible walled dispensing tube having a discharge nozzle at one end and a permanent closure at the other end, wherein the improvement comprises a rubber band attached to the other end, in a direction parallel to the other end, to prevent unwinding of the other end of the tube after it has been wound a plurality of revolutions, the rubber band being attached to the other end of the tube by a dead fold over a portion of the rubber band and the rubber band surrounding the tube at the other end in a direction parallel to the other end, to be used in preventing unwinding of the tube after the end of the tube has been wound a plurality of revolutions.

3. The improvement of claim 2 further characterized by a sleeve surrounding a portion of the lengthwise direction of the rubber band, the sleeve being so positioned and arranged so as to not interfere with the winding of the tube.

4. The improvement of claim 3 further characterized by the sleeve having a length equal to the width of the other end of the tube.

5. The improvement of claim 3 further characterized by the sleeve being inextensible.

6. The improvement of claim 3 further characterized by one or more letters or numbers being printed on the sleeve.

7. In a method of dispensing the contents of a plastic, flexible wall dispensing tube having a discharge nozzle at the top end and a permanent closure at the bottom end, the improvement comprising, a. attaching a rubber band around the tube parallel to the bottom end of the tube, b. rolling up the bottom end of the tube around a portion of the rubber band while leaving an exposed portion of the rubber band, and c. moving the exposed portion of the rubber band to the outer surface of the tube opposing the roll as each roll is made during a plurality of revolutions of the bottom end of the tube.

* * * * *